US010562732B2

(12) United States Patent
Egawa

(10) Patent No.: US 10,562,732 B2
(45) Date of Patent: Feb. 18, 2020

(54) SHEET POST-PROCESSOR AND IMAGE FORMING SYSTEM PROVIDED WITH THE SAME

(71) Applicant: KYOCERA Document Solutions Inc., Osaka (JP)

(72) Inventor: Keisuke Egawa, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 219 days.

(21) Appl. No.: 15/723,697

(22) Filed: Oct. 3, 2017

(65) Prior Publication Data

US 2018/0105386 A1 Apr. 19, 2018

(30) Foreign Application Priority Data

Oct. 13, 2016 (JP) ..... 2016-201448

(51) Int. Cl.
*B65H 35/04* (2006.01)
*G03G 15/00* (2006.01)
(Continued)

(52) U.S. Cl.
CPC ..... *B65H 35/04* (2013.01); *B26D 7/00* (2013.01); *B65H 5/00* (2013.01); *G03G 15/6582* (2013.01);
(Continued)

(58) Field of Classification Search
CPC ..... B65H 2701/1315; B65H 2801/27; B65H 2301/5152; B65H 35/04; B65H 5/00; B26D 7/00; G03G 15/6582
See application file for complete search history.

(56) References Cited

U.S. PATENT DOCUMENTS 7,007,577 B2 3/2006 Okamoto et al. ..... 83/6.8
2002/0079640 A1* 6/2002 Yoshie ..... B26D 7/2628 271/176
(Continued)

FOREIGN PATENT DOCUMENTS

JP 2002-160848 A 6/2002
JP 2009-83965 A 4/2009
(Continued)

OTHER PUBLICATIONS

Chinese Office Action dated Dec. 11, 2018, issued by the China National Intellectual Property Administration in corresponding application CN 201710942263.8.
(Continued)

*Primary Examiner* — David H Banh
(74) *Attorney, Agent, or Firm* — Stein IP, LLC

(57) ABSTRACT

A sheet post-processor of this disclosure is provided with a punching device and a registration roller. The punching device is capable of forming punch holes along a first side end edge of a sheet parallel to a sheet width direction orthogonal to a sheet conveyance direction and a second side end edge of the sheet parallel to the sheet conveyance direction. The registration roller is disposed downstream of the punching device in the sheet conveyance direction. The punching device includes a punch unit that forms punch holes through a sheet and an edge sensor that detects the second side end edge of a sheet. In a case of forming punch holes along the second side end edge of a sheet, without skewing of the sheet being corrected by the registration roller, the edge sensor detects the second side end edge, while the punch unit forms punch holes through the sheet.

4 Claims, 9 Drawing Sheets

(51) Int. Cl.
*B65H 5/00* (2006.01)
*B26D 7/00* (2006.01)

(52) U.S. Cl.
CPC ..... *B65H 2301/5152* (2013.01); *B65H 2701/1315* (2013.01); *B65H 2801/27* (2013.01)

(56) References Cited

U.S. PATENT DOCUMENTS

| | | | | |
|---|---|---|---|---|
| 2005/0212194 | A1* | 9/2005 | Moriyama | B26D 7/2628 270/58.08 |
| 2008/0260446 | A1* | 10/2008 | Harasawa | G03G 15/6582 399/408 |
| 2011/0211891 | A1 | 9/2011 | Nakamura | 399/407 |
| 2015/0076763 | A1* | 3/2015 | Katsura | B65H 7/02 271/227 |
| 2017/0235265 | A1* | 8/2017 | Deno | G03G 15/5054 399/316 |

FOREIGN PATENT DOCUMENTS

| | | | |
|---|---|---|---|
| JP | 2011-173718 | A | 9/2011 |
| JP | 2013-129470 | A | 7/2013 |
| JP | 2015-178416 | A | 10/2015 |

OTHER PUBLICATIONS

Japanese Office Action dated Dec. 11, 2018, issued by the Japanese Patent Office in corresponding application JP 201710942263.8.
Japanese Office Action dated Jun. 18, 2019, issued by the Japanese Patent Office in corresponding application JP 2016-201448.

* cited by examiner

SHEET POST-PROCESSOR AND IMAGE FORMING SYSTEM PROVIDED WITH THE SAME

INCORPORATION BY REFERENCE

This application is based upon and claims the benefit of priority from the corresponding Japanese Patent Application No. 2016-201448 filed on Oct. 13, 2016, the entire contents of which are incorporated herein by reference.

BACKGROUND

The present disclosure relates to a sheet post-processor that forms punch holes through a sheet such as a paper sheet on which an image has been formed by an image forming apparatus such as a copy machine or a printer, and an image forming system provided with the same.

Conventionally, there has been used a paper sheet post-processor that is capable of executing post-processing such as a binding process of stacking a plurality of paper sheets (sheets) on which images have been formed by an image forming apparatus such as a copy machine or a printer and binding together a bundle of the paper sheets thus stacked with a staple(s) and a punch hole formation process of forming punch holes (perforations) through the bundle of the paper sheets by using a punch unit.

As such a paper sheet post-processor, there is known a paper sheet post-processor provided with a punch unit that is capable of forming punch holes along a first side end edge of a paper sheet parallel to a paper sheet width direction orthogonal to a paper sheet conveyance direction and a second side end edge of the paper sheet parallel to the paper sheet conveyance direction and moves in the paper sheet width direction, an edge sensor that moves in the paper sheet width direction together with the punch unit and detects the second side end edge of the paper sheet, and a registration roller that is disposed downstream of the punch unit in the paper sheet conveyance direction and corrects skewing of the paper sheet by forming a warp in the paper sheet.

In this type of paper sheet post-processor, in a case of forming punch holes along the first side end edge of a paper sheet, after skewing of the paper sheet has been corrected by the registration roller, the punch unit and the edge sensor move in the paper sheet width direction, and the edge sensor detects the second side end edge of the paper sheet, while the punch unit forms punch holes through the paper sheet.

In a case of forming punch holes along the second side end edge of a paper sheet, however, there is a problem with the configuration in which, after skewing of the paper sheet has been corrected by the registration roller, the punch unit and the edge sensor move in the paper sheet width direction, and the edge sensor detects the second side end edge of the paper sheet. Specifically, in this configuration, in a case where a distance from a tip end of a paper sheet to a position on the paper sheet at which a first punch hole is to be formed is short, the punch unit and the edge sensor might fail to be properly displaced in time. That is, the punch unit and the edge sensor move in the paper sheet width direction, and the edge sensor detects the second side end edge of the paper sheet, while the punch unit moves to a prescribed position in the paper sheet width direction; before this happens, however, the position on the paper sheet at which the first punch hole is to be formed might reach the punch unit. To avoid this, it is required to stop the paper sheet from being conveyed for a duration longer than necessary, resulting in a decrease in productivity (the number of sheets processed per unit time). For this reason, in the case of forming punch holes along the second side end edge of a paper sheet, after the punch unit and the edge sensor have moved in the paper sheet width direction, and the edge sensor has detected the second side end edge of the paper sheet, skewing of the paper sheet is corrected by the registration roller, and the punch unit forms punch holes through the paper sheet.

SUMMARY

A sheet post-processor according to a first aspect of the present disclosure is provided with a punching device and a registration roller. The punching device is capable of forming punch holes along a first side end edge of a sheet parallel to a sheet width direction orthogonal to a sheet conveyance direction and a second side end edge of the sheet parallel to the sheet conveyance direction and moves in the sheet width direction. The registration roller is disposed downstream of the punching device in the sheet conveyance direction, corrects skewing of a sheet before formation of punch holes, and then conveys the sheet. The punching device includes a punch unit that forms punch holes through a sheet, an edge sensor that detects the second side end edge of a sheet, and a base portion that mounts the punch unit and the edge sensor and moves in the sheet width direction. In a case of forming punch holes along the second side end edge of a sheet, without skewing of the sheet being corrected by the registration roller, the base portion moves together with the punch unit and the edge sensor in the sheet width direction, and the edge sensor detects the second side end edge, while the punch unit as positioned based on a result of detection by the edge sensor forms punch holes through the sheet.

Still other objects of the present disclosure and specific advantages provided by the present disclosure will be made further apparent from the following descriptions of embodiments.

DETAILED DESCRIPTION

With reference to the appended drawings, the following describes embodiments of the present disclosure.

First Embodiment

With reference to FIG. 1 to FIG. 10, a description is given of an image forming system composed of a paper sheet post-processor (a sheet post-processor) 30 according to a first embodiment of the present disclosure and an image forming apparatus 10 to which the paper sheet post-processor 30 is coupled. While this embodiment exemplarily uses a multi-functional peripheral as one example of the image forming apparatus 10, the paper sheet post-processor 30 of the present disclosure can be coupled similarly also to an image forming apparatus of a type other than a multi-functional peripheral, such as, for example, a printer, a copy machine, or a facsimile apparatus.

Figure 1:
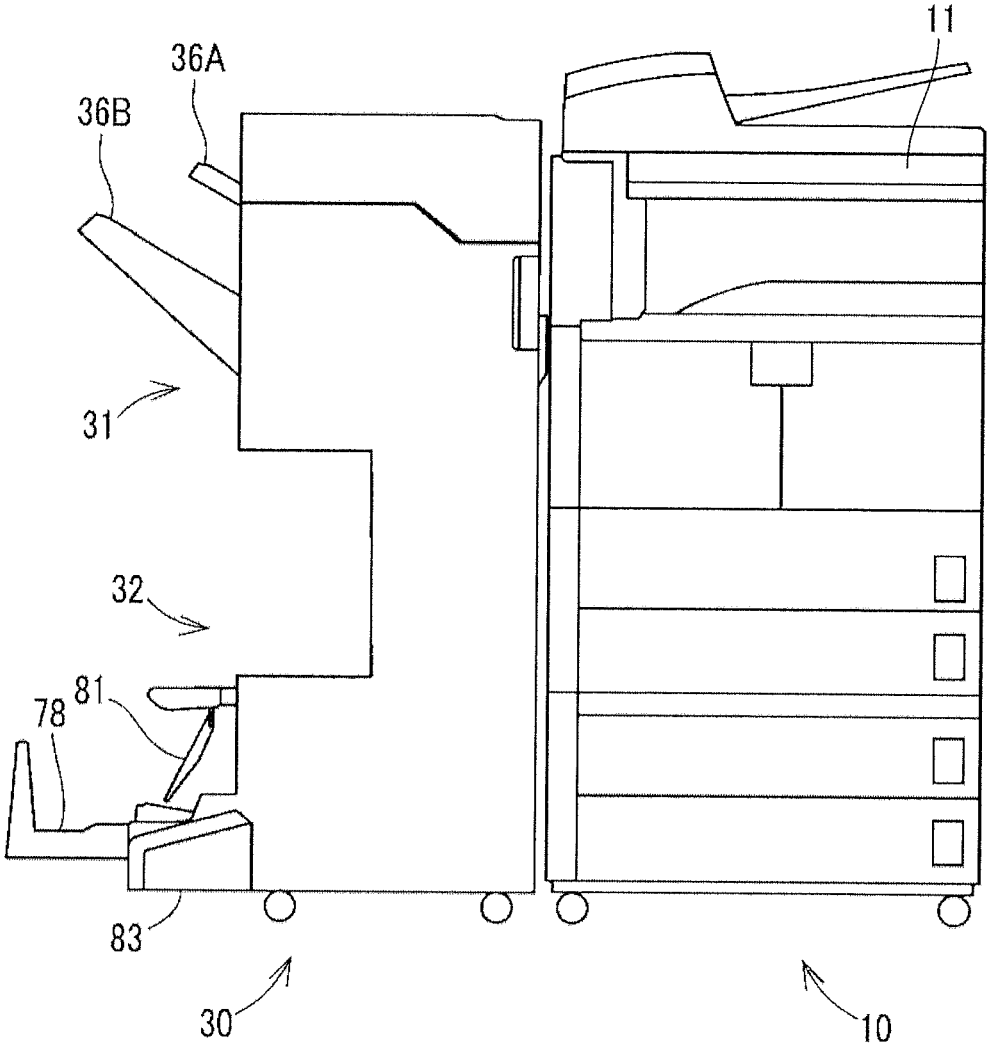
FIG. 1 is a schematic view showing configurations of a paper sheet post-processor of a first embodiment of the present disclosure and an image forming apparatus to which the paper sheet post-processor is coupled.
Figure 2:
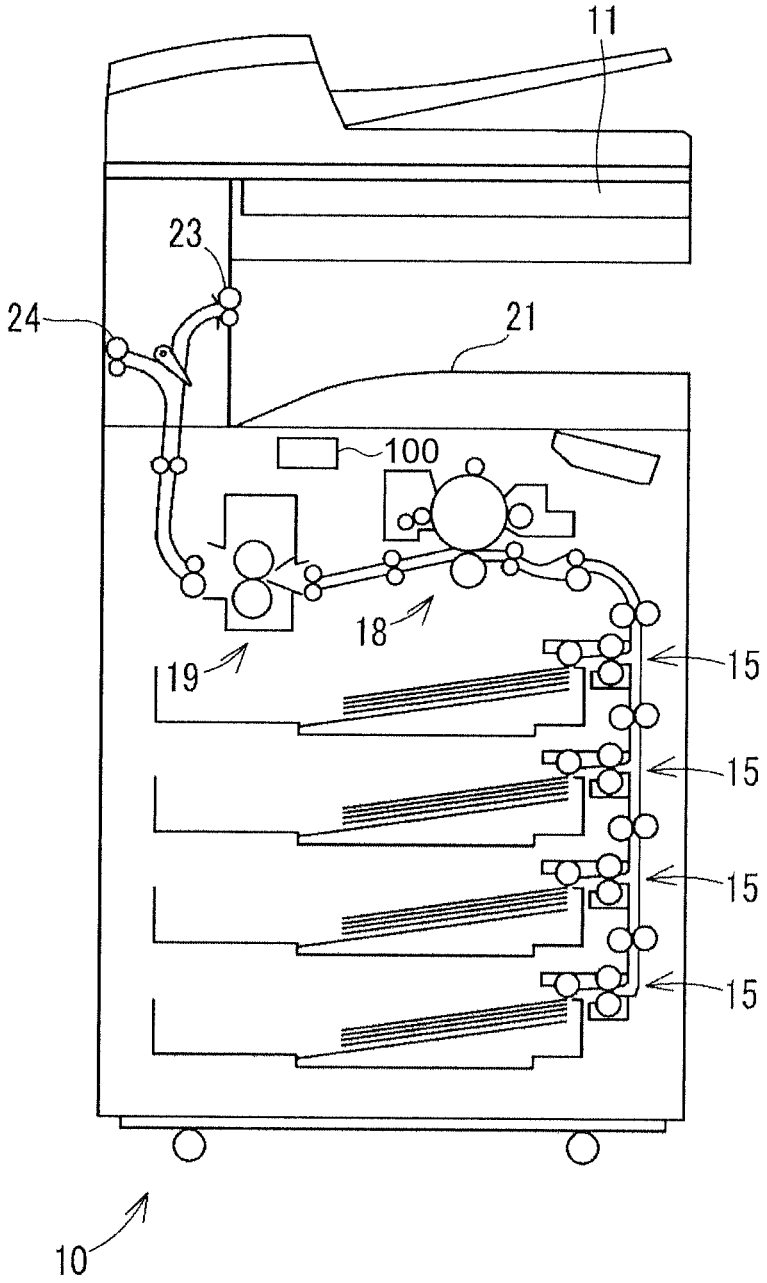
FIG. 2 is a sectional view showing a configuration of the image forming apparatus to which the paper sheet post-processor of the first embodiment of the present disclosure is coupled.

As shown in FIG. 1, the image forming apparatus 10 is coupled in use to the paper sheet post-processor 30. Based on image data externally inputted via an unshown network communication portion or image data read by an image reading portion 11 disposed in an upper portion of the image forming apparatus 10, the image forming apparatus 10 prints an image on a paper sheet. As shown in FIG. 2, the image forming apparatus 10 is provided with a paper feed portion 15 that feeds a paper sheet, an image forming portion 18 that forms a toner image on a paper sheet, a fixing portion 19 for fixing a toner image on a paper sheet, ejection roller pairs 23 and 24 that convey paper sheets that have undergone fixing and ejects the paper sheets to a paper ejection portion 21 and to the paper sheet post-processor 30, respectively, and a main body control portion 100. The main body control portion 100 controls an operation of the image forming apparatus 10 and is configured to be communicable with an after-mentioned post-processing control portion 101 of the paper sheet post-processor 30, thus controlling the post-processing control portion 101.

The paper sheet post-processor 30 performs, with respect to a paper sheet conveyed from the image forming apparatus 10, post-processing including a punch hole formation process, a binding process, a center folding process, and so on. The paper sheet post-processor 30 is not limited to a configuration in which post-processing is performed with respect to a paper sheet automatically conveyed from the image forming apparatus 10. The paper sheet post-processor 30 itself may convey a paper sheet placed on an unshown tray by a user to a position at which post-processing can be performed and perform the post-processing with respect to said paper sheet.

Figure 3:
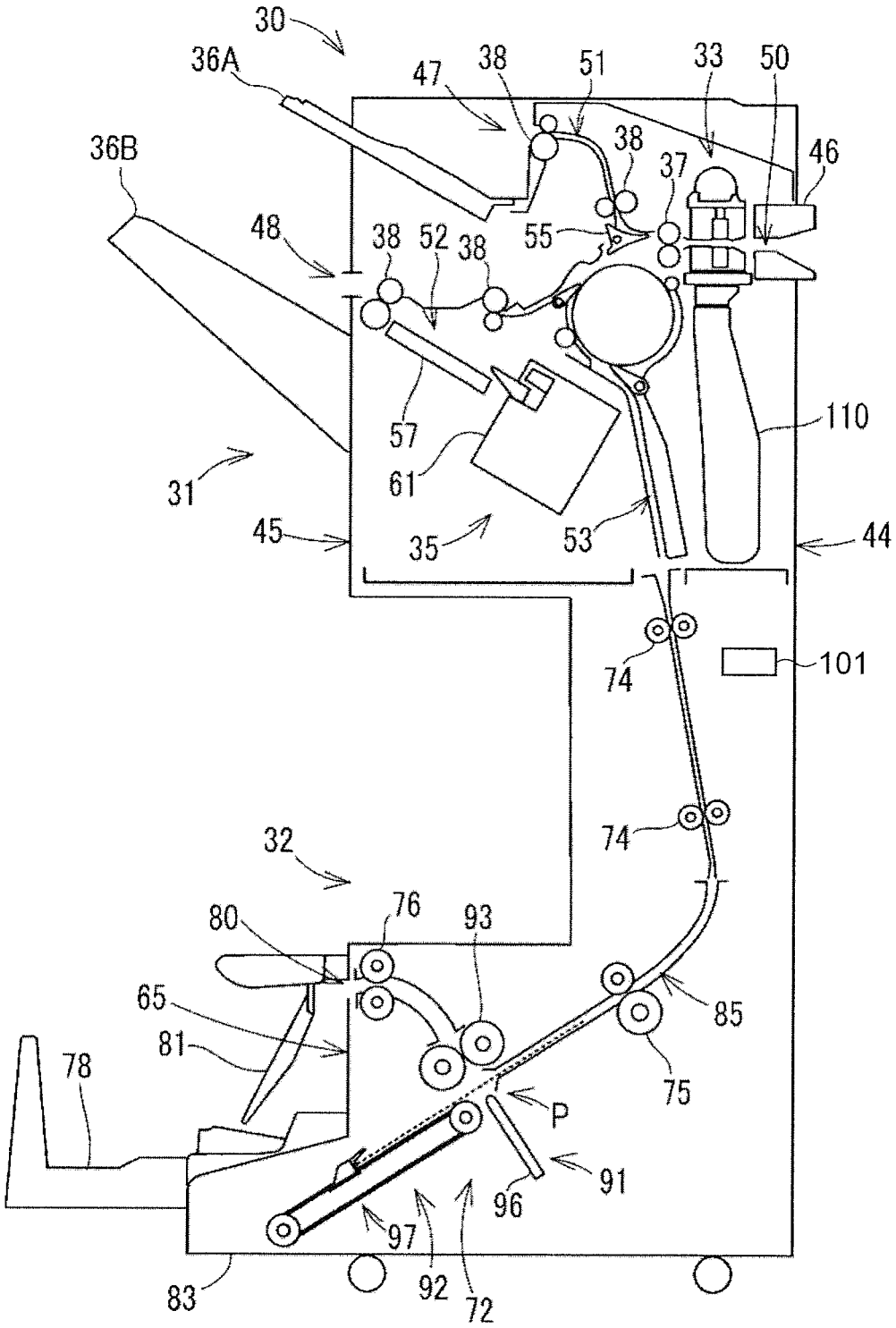
FIG. 3 is a sectional view showing a configuration of the paper sheet post-processor of the first embodiment of the present disclosure.

As shown in FIG. 3, the paper sheet post-processor 30 is provided with an upper main body 31 constituting an upper side of the paper sheet post-processor 30 and a lower main body 32 constituting a lower side thereof. The paper sheet post-processor 30 is provided further with the post-processing control portion 101 that performs centralized control of the paper sheet post-processor 30.

The upper main body 31 is provided on an upper side of the lower main body 32 and provided with a punching device 33, an accommodation container 110, a stapler unit 35, a registration roller 37, a plurality of conveyance roller pairs 38, an upper tier tray 36A, and a lower tier tray 36B. These components are provided in a housing constituting a casing or an interior frame of the paper sheet post-processor 30. Each of the registration roller 37 and the conveyance roller pairs 38 is composed of a driving roller and a driven roller and conveys a paper sheet conveyed from the image forming apparatus 10. The punching device 33 performs a punch hole formation process with respect to a paper sheet conveyed from the image forming apparatus 10. The stapler unit 35 performs a binding process with respect to a paper sheet. The upper tier tray 36A and the lower tier tray 36B hold paper sheets ejected from the paper sheet post-processor 30.

The upper main body 31 has, on a coupling surface 44 used for coupling to the image forming apparatus 10 (a right side surface in FIG. 3), a carry-in port 46 as an entrance for accepting a paper sheet that has undergone image formation and is conveyed from the image forming apparatus 10. In a neighborhood of an upper surface of the upper main body 31, there is provided an ejection port 47 for ejecting a paper sheet from the paper sheet post-processor 30 to outside. The upper tier tray 36A is provided in continuation from the ejection port 47. Furthermore, on a side surface 45 of the upper main body 31 (a left side surface in FIG. 3), there is provided an ejection port 48 for ejecting a paper sheet from the paper sheet post-processor 30 to outside. The lower tier tray 36B is provided in continuation from the ejection port 48.

Inside the upper main body 31, a paper sheet conveyance path 50 is formed that horizontally extends from the carry-in port 46. On the paper sheet conveyance path 50, the punching device 33 is provided, and the registration roller 37 is provided downstream of the punching device 33 in a paper sheet conveyance direction.

The punching device 33 is capable of performing punch hole formation with respect to a paper sheet conveyed along the paper sheet conveyance path 50. When a paper sheet is conveyed to a prescribed position on the paper sheet conveyance path 50, punch holes are formed in an end portion of the paper sheet by the punching device 33. The accommodation container 110 is provided below the punching device 33 and collects and accommodates odd pieces of paper (punch chips) resulting from punch hole formation by the punching device 33. A detailed configuration in a vicinity of the punching device 33 will be mentioned later.

The paper sheet conveyance path 50 branches off into a paper sheet conveyance path 51 directed to an upper surface side of the upper main body 31, a paper sheet conveyance path 52 directed to the side surface 45, and a paper sheet conveyance path 53 directed to the lower main body 32. The paper sheet conveyance path 51 leads to the ejection port 47, and the paper sheet conveyance path 52 leads to the ejection port 48 via the stapler unit 35. The paper sheet conveyance path 53 leads to an after-mentioned center folding unit 72 included in the lower main body 32.

A branching member 55 that is driven to swivel by an unshown drive portion such as a motor or a solenoid is provided at a branching point at which the paper sheet conveyance path 50 branches off into the paper sheet conveyance paths 51 to 53. The branching member 55 is driven to swivel to an appropriate position, and thus a paper sheet is conveyed to a predetermined one of the paper sheet conveyance paths 51 to 53.

The stapler unit 35 is provided downstream from the punching device 33 in the paper sheet conveyance direction and in a neighborhood of the paper sheet conveyance path 52. The stapler unit 35 is provided with a process tray 57 and a stapler device 61.

A paper sheet conveyed to the paper sheet conveyance path 52 is sequentially stacked on the process tray 57. The stapler device 61 performs a binding process with respect to a prescribed number of paper sheets (a bundle of paper sheets) stacked on the process tray 57. The bundle of paper sheets that has undergone the binding process are ejected onto the lower tier tray 36B by one of the conveyance roller pairs 38.

The lower main body 32 is provided with the center folding unit 72, an exterior tray 78, and a plurality of conveyance roller pairs 74. These components are provided in the housing constituting the casing or the interior frame of the paper sheet post-processor 30.

The conveyance roller pairs 74 are provided in an upper portion of the lower main body 32 and disposed along the paper sheet conveyance path 53. The conveyance roller pairs 74 are each composed of a driving roller and a driven roller that convey a paper sheet downward.

In a lower-side portion of the lower main body 32, there is formed a paper sheet conveyance path 85 that is connected to a lower end of the paper sheet conveyance path 53. The paper sheet conveyance path 85 is provided with a conveyance roller pair 75. The paper sheet conveyance path 85 is bent from the lower end of the paper sheet conveyance path 53 toward a side surface 65 (a left side in FIG. 3) to lead to a process position P at which a center folding process by the center folding unit 72 is performed. Furthermore, the center folding unit 72 and the exterior tray 78 are provided in the lower-side portion of the lower main body 32. On the side surface 65 of the lower main body 32 (a left side surface in FIG. 3), there is provided an ejection port 80 for ejecting a paper sheet center-folded by the center folding unit 72. Furthermore, in a neighborhood of the ejection port 80, a paper sheet presser 81 is provided that presses downward a paper sheet ejected through the ejection port 80. Furthermore, on a lower side of the ejection port 80, a projection portion 83 is provided that projects from the side surface 65 to a lateral direction (a leftward direction in FIG. 3). The projection portion 83 is a portion that allows an interior space of the lower main body 32 to expand outward with respect to the side surface 65 and constitutes part of the lower main body 32. Part of the center folding unit 72 is accommodated inside the projection portion 83.

The center folding unit 72 is disposed in a neighborhood of a terminal end of the paper sheet conveyance path 85. The center folding unit 72 center-folds a paper sheet guided through the paper sheet conveyance path 85 to the process position P and is provided with a bending portion 91 and a center alignment portion 92. The bending portion 91 has a blade 96 that is caused to reciprocate in a direction perpendicular to a paper sheet by an unshown reciprocation mechanism. The center alignment portion 92 operates a belt moving mechanism 97 or the like to cause a paper sheet to move along the paper sheet conveyance direction. When a center of a paper sheet is aligned with the process position P by the center alignment portion 92, the blade 96 is caused to move and thus bends the paper sheet in such a manner that a side of the paper sheet opposite to the blade 96 is deformed into a mountain fold shape. The paper sheet is conveyed while a thus mountain-folded portion thereof is held between rollers of a bending roller pair 93, so that the paper sheet is center-folded. The paper sheet thus center-folded is ejected in a folded state by an ejection roller pair 76 onto the external tray 78 through the ejection port 80.

The post-processing control portion 101 is composed of a CPU (central processing unit), a ROM (read-only memory), a RAM (random-access memory), and so on. Furthermore, the post-processing control portion 101 is configured to be communicable with the punching device 33, the stapler unit 35, the center folding unit 72, and the various roller pairs and executes a punch hole formation process, a binding process, a center folding process, a paper sheet ejection process, and so on.

Next, a description is given of a detailed structure in a vicinity of the punching device 33.

Figure 4:
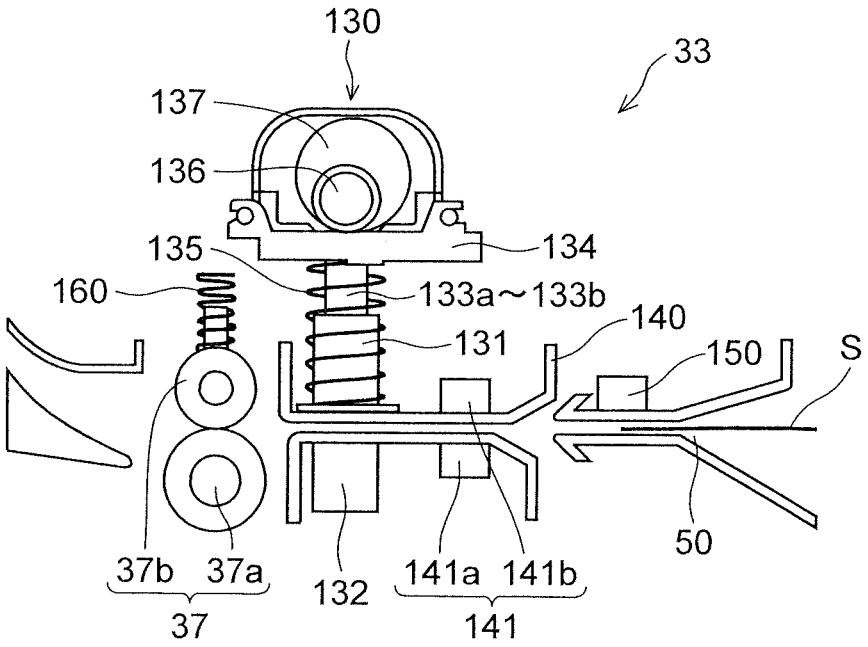
FIG. 4 is a view showing a structure in a vicinity of a punching device in the paper sheet post-processor of the first embodiment of the present disclosure, which illustrates a state where a tip end of a paper sheet has reached a tip end detection sensor.

As shown in FIG. 4, the punching device 33 is composed of a punch unit 130 that is capable of forming punch holes through a paper sheet S conveyed along the paper sheet conveyance path 50, an edge sensor 141 that detects a second side end edge of the paper sheet S parallel to the paper sheet conveyance direction, and a base portion 140 that holds the punch unit 130 and the edge sensor 141.

Figure 5:
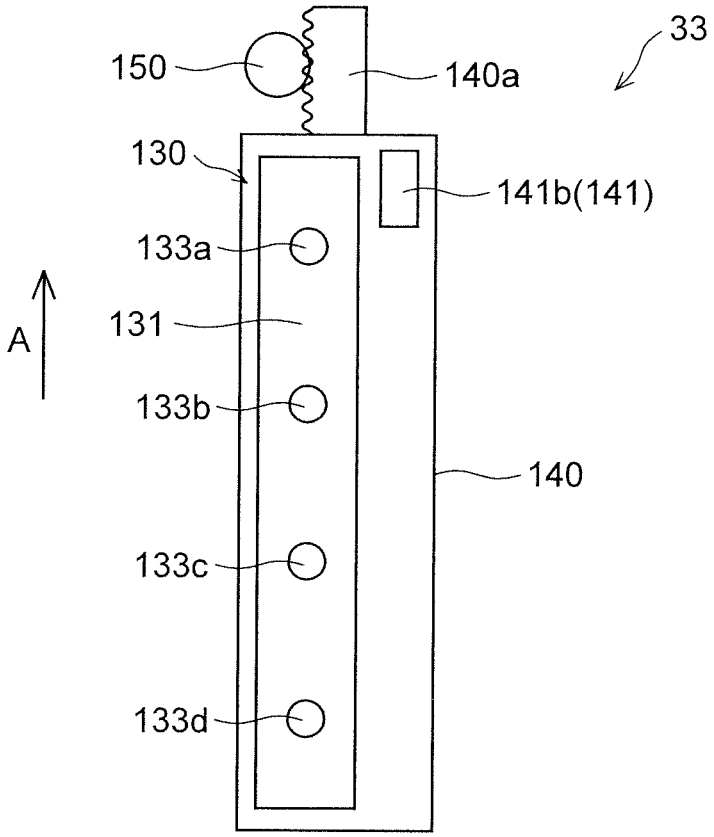
FIG. 5 is a plan view showing a structure in a vicinity of punch members in the paper sheet post-processor of the first embodiment of the present disclosure.

As shown in FIG. 5, a rack portion 140*a* is provided at one end of the base portion 140 (an end portion thereof on a depth side of the paper sheet post-processor 30 (an arrow A direction)) in a paper sheet width direction (a direction perpendicular to the paper sheet conveyance direction, an up-down direction in FIG. 5). The rack portion 140*a* is meshed with a pinion gear 150 to which a rotational drive force is transmitted from a drive source (not shown) formed of a stepping motor or the like. The pinion gear 150 rotates, and thus the base portion 140 moves in the paper sheet width direction. Accordingly, the punch unit 130 and the edge sensor 141 move in the paper sheet width direction. The rack portion 140*a*, the pinion gear 150, and the drive source constitute a movement mechanism for causing the punch unit 130 and the edge sensor 141 to move in the paper sheet width direction.

As shown in FIG. 4 and FIG. 5, the edge sensor 141 is disposed upstream of the punch unit 130 in the paper sheet conveyance direction and on an outer side (an upper side in FIG. 5) in the paper sheet width direction with respect to after-mentioned punch members 133*a* to 133*d* of the punch unit 130. The edge sensor 141 is formed of, for example, a transmission-type sensor and is composed of a light emitting portion 141*a* and a light receiving portion 141*b* that are disposed to be opposed to each other via the paper sheet conveyance path 50. The edge sensor 141 may be formed of a reflection-type sensor.

As shown in FIG. 4, a tip end detection sensor 150 that detects a tip end of the paper sheet S (a first side end edge of the paper sheet S parallel to the paper sheet width direction) is provided upstream of the punching device 33 in the paper sheet conveyance direction. The tip end detection sensor 150 is formed of, for example, a reflection-type sensor. The tip end detection sensor 150 may be formed of a transmission-type sensor.

The registration roller 37 is disposed downstream of the punching device 33 in the paper sheet conveyance direction. The registration roller 37 corrects skewing of the paper sheet S by forming a warp in the paper sheet S. The registration roller 37 is composed of a driving roller 37*a* to which a rotational drive force is transmitted from an unshown drive source and a driven roller 37*b* that is brought into pressure contact with the driving roller 37*a*. The driven roller 37*b* is brought into pressure contact with the driving roller 37*a* by a biasing member 160 formed of a compression spring.

The punch unit 130 has an upper mold 131 and a die 132 that are disposed to be opposed to each other in an up-down direction via the paper sheet conveyance path 50. As shown in FIG. 5, the upper mold 131 is formed to extend in the paper sheet width direction. Similarly to the upper mold 131, the die 132 is also formed to extend in the paper sheet width direction.

The upper mold 131 is provided with the plurality of (herein, four) punch members 133*a*, 133*b*, 133*c*, and 133*d* that form punch holes through the paper sheet S. The punch members 133*a* to 133*d* are disposed at prescribed intervals in the paper sheet width direction. The upper mold 131 has a plurality of (herein, four) holes into which the punch members 133*a* to 133*d* are disposed, respectively. The die 132 has a plurality of (herein, four) die holes at positions thereon corresponding to the punch members 133*a* to 133*d*, respectively. The punch members 133*a* to 133*d* are movable in the up-down direction with respect to the upper mold 131 and pressed into the die holes of the die 132, thus forming punch holes through the paper sheet S.

As shown in FIG. 4, upper portions of the punch members 133*a* to 133*d* are supported to four support members 134 that are provided in correspondence with the punch members 133*a* to 133*d*, respectively. A lower surface of each of the support members 134 is biased upward by a biasing member 135 formed of a compression spring. Inside the four support members 134, one rotary shaft 136 is provided that extends in the paper sheet width direction and is rotatably supported by the base portion 140. Four eccentric cams 137 provided in correspondence with the four support members 134, respectively, are secured to the rotary shaft 136. The eccentric cams 137 are secured eccentrically with respect to the rotary shaft 136 and rotate together with the rotary shaft 136, thus causing the support members 134 and the punch members 133*a* to 133*d* to move in the up-down direction.

The rotary shaft 136 is configured to be rotatable in the paper sheet width direction by an unshown rotary shaft movement mechanism, and each of the eccentric cams 137 is selectively disposed at a position at which it comes in contact with a corresponding one of the support members 134 or at a position at which it does not come in contact therewith. Thus, the punch members 133*a* to 133*d* are movable in the up-down direction independently of each other. It is sufficient that, among the punch members 133*a* to 133*d*, at least the punch member 133*a* is movable in the up-down direction independently of the punch members 133*b* and 133*c*. The following description is directed to a case where the punch members 133*a* and 133*d* move in the up-down direction at the same time, and the punch members 133*b* and 133*c* move in the up-down direction at the same time. The punch member 133*a* is used to form punch holes along the second side end edge of the paper sheet S (the second side end edge thereof on the depth side of the paper sheet post-processor 30) parallel to the paper sheet conveyance direction, the punch member 133*d* is used to form punch holes along the second side end edge of the paper sheet S (the second side end edge thereof on a forward side of the paper sheet post-processor 30) parallel to the paper sheet conveyance direction, and the punch members 133*b* and 133*c* are used to form punch holes along a rear end of the paper sheet S (the first side end edge thereof parallel to the paper sheet width direction).

Next, a description is given of a punch hole formation process operation by the paper sheet post-processor 30.

The paper sheet S (for example, an A4-sized paper sheet) to be subjected to a punch hole formation process is carried into the paper sheet post-processor 30, and upon detection of a tip end of the paper sheet S by the tip end detection sensor 150 (a state shown in FIG. 4), the punch hole formation process is started.

Figure 6:
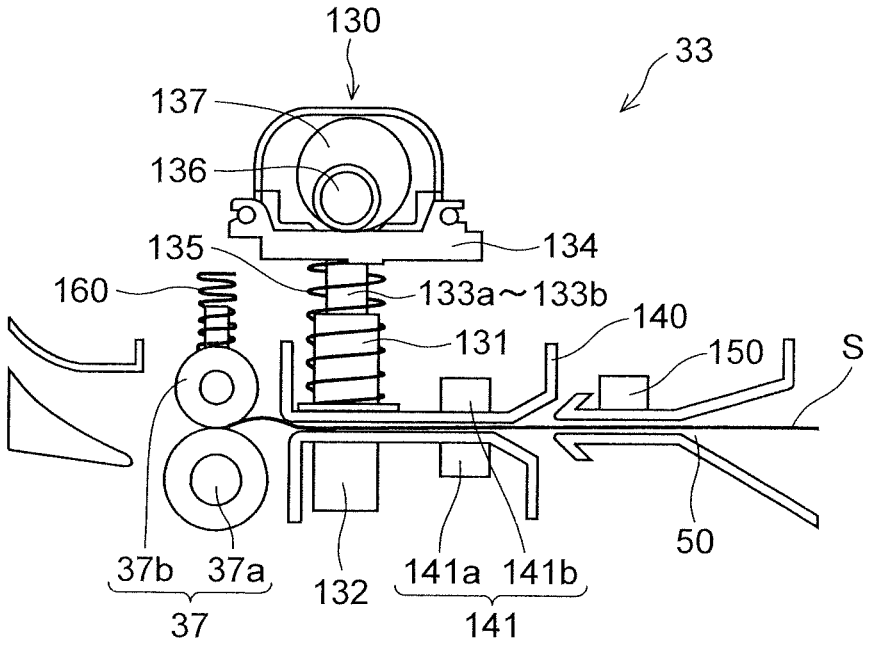
FIG. 6 is a view showing a structure in the vicinity of the punching device in the paper sheet post-processor of the first embodiment of the present disclosure, which illustrates a state where a warp is being formed by a registration roller.

When it is instructed to form punch holes along a rear end (the first side end edge, a short side) of the paper sheet S, while a rotation stopped state of the registration roller 37 is maintained, as shown in FIG. 6, the tip end of the paper sheet S is brought into contact with the registration roller 37 so that a warp is generated in the paper sheet S, and thus skewing of the paper sheet S is corrected.

Figure 7:
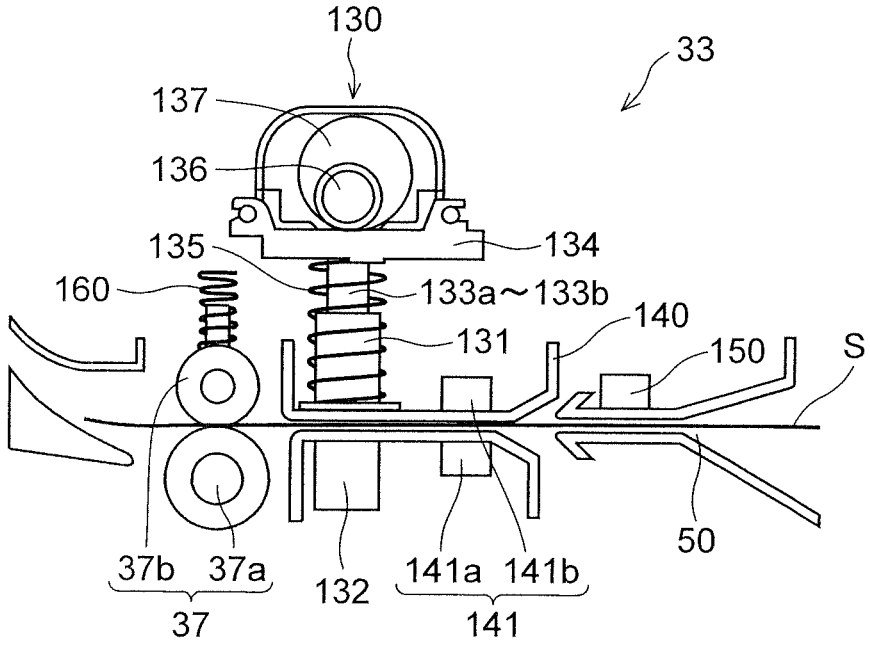
FIG. 7 is a view showing a structure in the vicinity of the punching device in the paper sheet post-processor of the first embodiment of the present disclosure, which illustrates a state where a paper sheet is being conveyed by the registration roller.

After that, as shown in FIG. 7, the registration roller 37 is caused to rotate so that the paper sheet S is conveyed in a state of being nipped by the registration roller 37. Then, the base portion 140 is caused to move in the paper sheet width direction (to the forward side of the paper sheet post-processor 30), and thus the edge sensor 141 detects the second side end edge of the paper sheet S. Based on a result of this detection, the base portion 140 is disposed at a prescribed position in the paper sheet width direction.

After that, the rear end of the paper sheet S passes through the tip end detection sensor 150, and thus the tip end detection sensor 150 detects the rear end of the paper sheet S. Based on a result of this detection, the paper sheet S is conveyed further by a prescribed amount (to such an extent that positions on the paper sheet S at which punch holes are to be formed are aligned with positions immediately under the punch members 133*b* and 133*c*).

Figure 8:
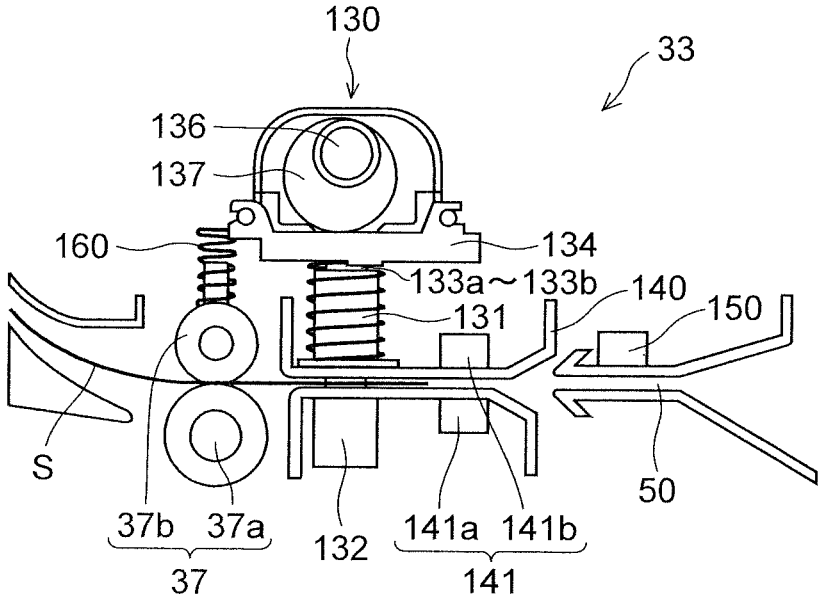
FIG. 8 is a view showing a structure in the vicinity of the punching device in the paper sheet post-processor of the first embodiment of the present disclosure, which illustrates a state where punch holes are being formed along a rear end of a paper sheet.

Then, as shown in FIG. 8, the punch members 133*b* and 133*c* are caused to descend and ascend to form punch holes along the rear end of the paper sheet S. During the punch hole formation process, the paper sheet S is temporarily stopped from being conveyed. After that, the registration roller 37 conveys the paper sheet S toward the paper sheet conveyance paths 51 to 53, and thus the punch hole formation process by the paper sheet post-processor 30 is completed.

On the other hand, when it is instructed to form three or more (herein, four) punch holes along the second side end edge (a long side) of the paper sheet S, before a tip end of the paper sheet S reaches the registration roller 37, the registration roller 37 is switched from a rotation stopped state to a rotation state. Thus, when the tip end of the paper sheet S is nipped by the registration roller 37, skew correction of the paper sheet S is not performed.

Furthermore, at timing when a position on the paper sheet S at which a first punch hole is to be formed reaches the edge sensor 141 in the paper sheet conveyance direction, the base portion 140 is caused to move in the paper sheet width direction (to the forward side of the paper sheet post-processor 30), and thus the edge sensor 141 detects the second side end edge of the paper sheet S. Based on a result of this detection, the base portion 140 is disposed at a prescribed position in the paper sheet width direction. In a case where a distance between the punch member 133*a* and the edge sensor 141 in the paper sheet width direction is equal to a distance between the position on the paper sheet S at which the first punch hole is to be formed and the second side end edge of the paper sheet S (the second side end edge of the paper sheet S on a side on which punch holes are to be formed (an upper side in FIG. 5)) in the paper sheet width direction, at the same time that the edge sensor 141 detects the second side end edge of the paper sheet S, the base portion 140 is stopped from moving in the paper sheet width direction. In a case where the distance between the punch member 133*a* and the edge sensor 141 in the paper sheet width direction is not equal to the distance between the position on the paper sheet S at which the first punch hole is to be formed and the second side end edge of the paper sheet S in the paper sheet width direction, after the edge sensor 141 has detected the second side end edge of the paper sheet S, the base portion 140 is caused to move by a prescribed amount in the paper sheet width direction.

Figure 9:
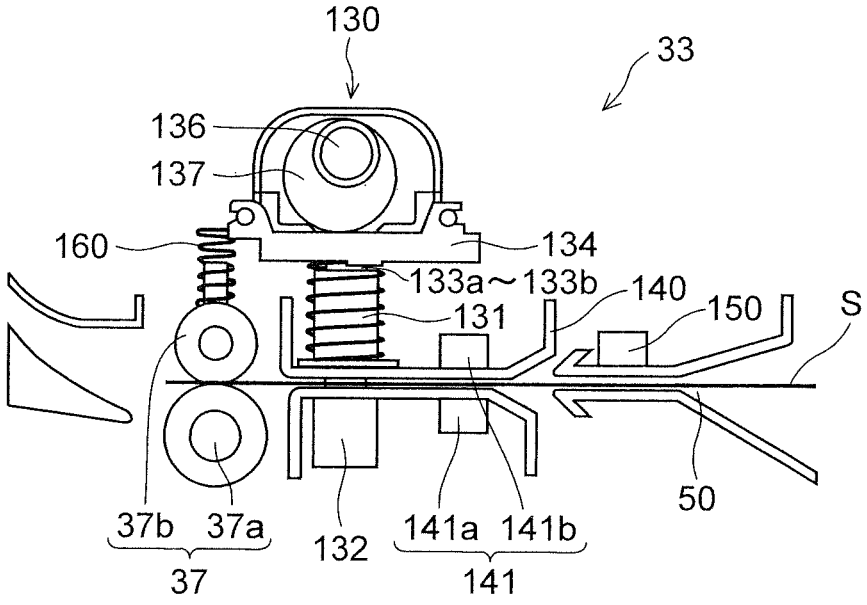
FIG. 9 is a view showing a structure in the vicinity of the punching device in the paper sheet post-processor of the first embodiment of the present disclosure, which illustrates a state where punch holes are being formed along a second side end edge of a paper sheet.

After that, as shown in FIG. 9, when the position on the paper sheet S at which the first punch hole is to be formed reaches the punch member 133*a*, the punch member 133*a* is caused to descend and ascend to form the first punch hole through the paper sheet S. At this time, the punch member 133*d* is also caused to descend and ascend. The punch member 133*d*, however, is disposed on an outer side (the forward side) of the paper sheet S in a width direction thereof and thus forms no punch hole through the paper sheet S. In this embodiment, before the position on the paper sheet S at which the first punch hole is to be formed reaches the punch member 133*a*, the tip end of the paper sheet S has already reached the registration roller 37, and the punch hole, therefore, is formed through the paper sheet S in a state where the paper sheet S is temporarily stopped from being conveyed and nipped by the registration roller 37.

Then, the base portion 140 is caused to move in such a direction that the edge sensor 141 will no longer detect the paper sheet S (to an outer side in the paper sheet width direction, to the depth side of the paper sheet post-processor 30), and at a point in time when the edge sensor 141 no longer detects the paper sheet S, the base portion 140 is stopped from moving. Concurrently therewith, the paper sheet S is conveyed further by the registration roller 37, and at timing when a position on the paper sheet S at which a second punch hole is to be formed reaches the edge sensor 141, the base portion 140 is caused to move to an inner side in the paper sheet width direction, and thus the edge sensor 141 detects the second side end edge of the paper sheet S. Based on a result of this detection, the base portion 140 is disposed at a prescribed position in the paper sheet width direction. Or alternatively, at the same time that the edge sensor 141 detects the second side end edge of the paper sheet S, the base portion 140 is stopped from moving in the paper sheet width direction.

After that, the paper sheet S is conveyed further by the registration roller 37, and when the position on the paper sheet S at which the second punch hole is to be formed reaches the punch member 133*a*, the paper sheet S is temporarily stopped from being conveyed, and the punch member 133*a* is caused to descend and ascend to form the second punch hole through the paper sheet S.

Then, in a similar manner to forming the second punch hole, third and fourth punch holes are formed through the paper sheet S.

After that, the registration roller 37 conveys the paper sheet S toward the paper sheet conveyance paths 51 to 53, and thus the punch hole formation process by the paper sheet post-processor 30 is completed.

Furthermore, when it is instructed to form two or less (herein, two) punch holes along the second side end edge of the paper sheet S, while a rotation stopped state of the registration roller 37 is maintained, as shown in FIG. 6, a tip end of the paper sheet S is brought into contact with the registration roller 37 so that a warp is generated in the paper sheet S, and thus skewing of the paper sheet S is corrected.

After that, as shown in FIG. 7, the registration roller 37 is caused to rotate so that the paper sheet S is conveyed in a state of being nipped by the registration roller 37. Then, the base portion 140 is caused to move in the paper sheet width direction, and thus the edge sensor 141 detects the second side end edge of the paper sheet S. Based on a result of this detection, the base portion 140 is disposed at a prescribed position in the paper sheet width direction.

Figure 10:
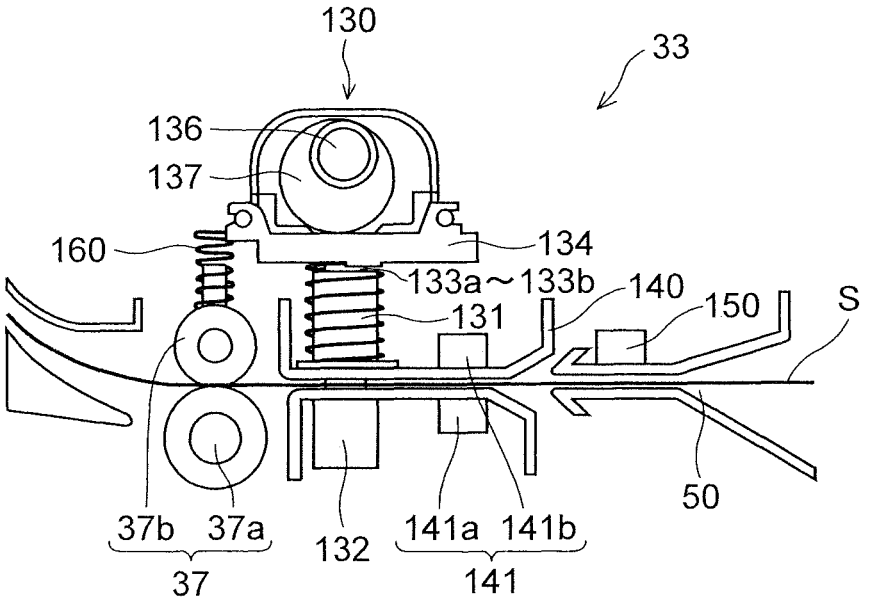
FIG. 10 is a view showing the structure in the vicinity of the punching device in the paper sheet post-processor of the first embodiment of the present disclosure, which illustrates a state where punch holes are being formed along the second side end edge of a paper sheet.

After that, when, as shown in FIG. 10, a position on the paper sheet S at which a first punch hole is to be formed reaches the punch member 133*a*, the paper sheet S is temporarily stopped from being conveyed, and the punch member 133*a* is caused to descend and ascend to form the first punch hole through the paper sheet S.

Then, the paper sheet S is conveyed further by the registration roller 37. When a position on the paper sheet S at which a second punch hole is to be formed reaches the punch member 133*a*, the paper sheet S is temporarily stopped from being conveyed, and the punch member 133*a* is caused to descend and ascend to form the second punch hole through the paper sheet S.

After that, the registration roller 37 conveys the paper sheet S toward the paper sheet conveyance paths 51 to 53, and thus the punch hole formation process by the paper sheet post-processor 30 is completed.

In this embodiment, as described above, in a case of forming three or more (herein, four) punch holes along the second side end edge of the paper sheet S, without skewing of the paper sheet S being corrected by the registration roller 37, the punch unit 130 and the edge sensor 141 move in the paper sheet width direction, and the edge sensor 141 detects the second side end edge of the paper sheet S, while the punch unit 130 forms punch holes through the paper sheet S. With this configuration, unlike the conventional type of paper sheet post-processor, in a case of forming punch holes along the second side end edge of a paper sheet, after the edge sensor has detected the second side end edge of the paper sheet, correction of skewing of the paper sheet is not performed by the registration roller. This can suppress a phenomenon in which a position of the second side end edge of a paper sheet in the paper sheet width direction varies under an influence of registration correction. Thus, punch holes can be formed with accuracy at desired positions along the second side end edge of the paper sheet S.

Furthermore, as described above, in a case of forming punch holes along the second side end edge of the paper sheet S, in a state where the paper sheet S is nipped by the registration roller 37, punch holes are formed through the paper sheet S by the punch unit 130. With this configuration, a more stable state of a paper sheet can be achieved when punch holes are formed therethrough.

Furthermore, as described above, in a case of forming a plurality of (herein, four) punch holes along the second side end edge of the paper sheet S, with respect to each of punch holes to be formed, the punch unit 130 and the edge sensor 141 move in the paper sheet width direction, and the edge sensor 141 detects the second side end edge of the paper sheet S. With this configuration, second and subsequent punch holes can be formed at desired positions with more accuracy.

Furthermore, as described above, in a case of forming two or less punch holes along the second side end edge of the paper sheet S, after skewing of the paper sheet S has been corrected by the registration roller 37, the punch unit 130 and the edge sensor 141 move in the paper sheet width direction, and the edge sensor 141 detects the second side end edge of the paper sheet S, while the punch unit 130 forms punch holes through the paper sheet S. In the case of forming two or less punch holes along the second side end edge of the paper sheet S, a distance from a tip end of the paper sheet S to a position on the paper sheet S at which a first punch hole is to be formed is relatively long, and thus in no case do the punch unit 130 and the edge sensor 141 fail to be properly displaced in time. That is, in no case does the position on the paper sheet S at which the first punch hole is to be formed reach the punch unit 130 before the punch unit 130 and the edge sensor 141 move in the paper sheet width direction, and the edge sensor 141 detects the second side end edge of the paper sheet S, while the punch unit 130 moves to a prescribed position in the paper sheet width direction. Accordingly, in the case of forming two or less punch holes along the second side end edge of the paper sheet S, the following can be achieved. That is, after skewing of the paper sheet S has been corrected by the registration roller 37, the punch unit 130 and the edge sensor 141 move in the paper sheet width direction, and the edge sensor 141 detects the second side end edge of the paper sheet S. Thus, punch holes can be formed at desired positions with more accuracy.

This embodiment has explained that, in a case of forming three or more punch holes along the second side end edge of the paper sheet S, skew correction of the paper sheet S by the registration roller 37 is not performed, and in a case of forming two or less punch holes, skew correction of the paper sheet S by the registration roller 37 is performed. The present disclosure, however, is not limited thereto. Whether or not to perform skew correction of the paper sheet S is determined based on whether or not a distance from a tip end of the paper sheet S to a position on the paper sheet S at which a first punch hole is to be formed is not less than a prescribed value. That is, in a case where the distance from the tip end of the paper sheet S to the position on the paper sheet S at which the first punch hole is to be formed is less than the prescribed value, regardless of the number of punch holes, skew correction of the paper sheet S by the registration roller 37 is not performed, and in a case where the distance from the tip end of the paper sheet S to the position on the paper sheet S at which the first punch hole is to be formed is not less than the prescribed value, skew correction of the paper sheet S by the registration roller 37 is performed. The prescribed value is determined based on a distance from the registration roller 37 to the punch members 133*a* to 133*d*, a paper sheet conveyance speed of the registration roller 37, a speed at which the base portion 140 moves in the paper sheet width direction, or the like.

Second Embodiment

Figure 11:
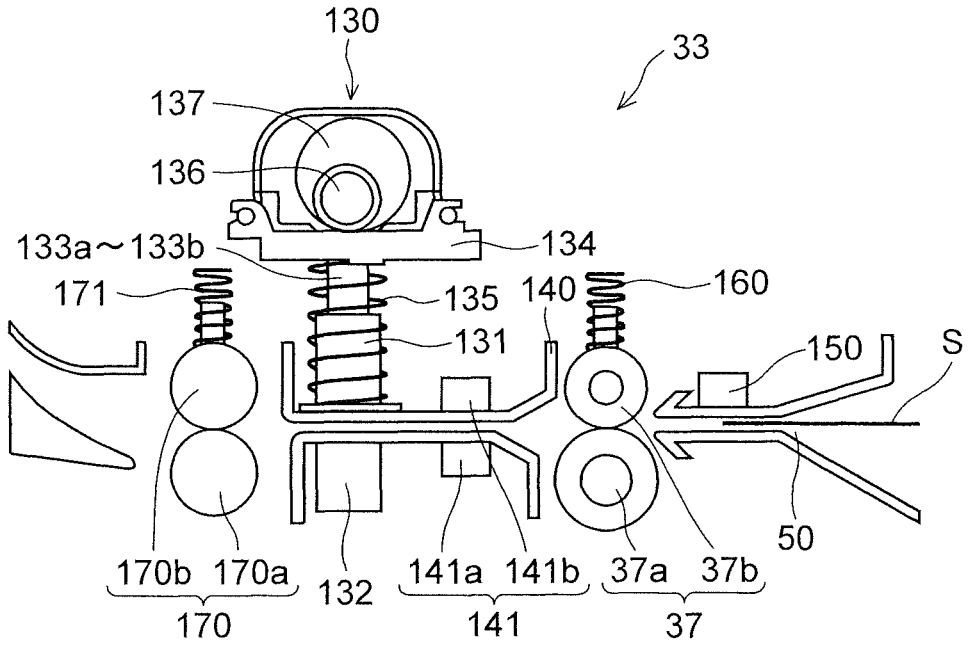
FIG. 11 is a view showing a structure in a vicinity of a punching device in a paper sheet post-processor of a second embodiment of the present disclosure, which illustrates a state where a tip end of a paper sheet has reached a tip end detection sensor.

In a paper sheet post-processor 30 of a second embodiment, as shown in FIG. 11, a registration roller 37 is disposed upstream of a punching device 33 in a paper sheet conveyance direction and downstream of a tip end detection sensor 150 in the paper sheet conveyance direction.

A conveyance roller pair 170 is provided downstream of the punching device 33 in the paper sheet conveyance direction. The conveyance roller pair 170 is composed of a driving roller 170*a* to which a rotational drive force is transmitted from an unshown drive source and a driven roller 170*b* that is brought into pressure contact with the driving roller 170*a*. The driven roller 170*b* is brought into pressure contact with the driving roller 170*a* by a biasing member 171 formed of a compression spring.

Other components in the second embodiment are structured similarly to those in the foregoing first embodiment.

Next, a description is given of a punch hole formation process operation by the paper sheet post-processor 30.

A paper sheet S to be subjected to a punch hole formation process is carried into the paper sheet post-processor 30, and upon detection of a tip end of the paper sheet S by the tip end detection sensor 150 (a state shown in FIG. 11), the punch hole formation process is started.

Figure 12:
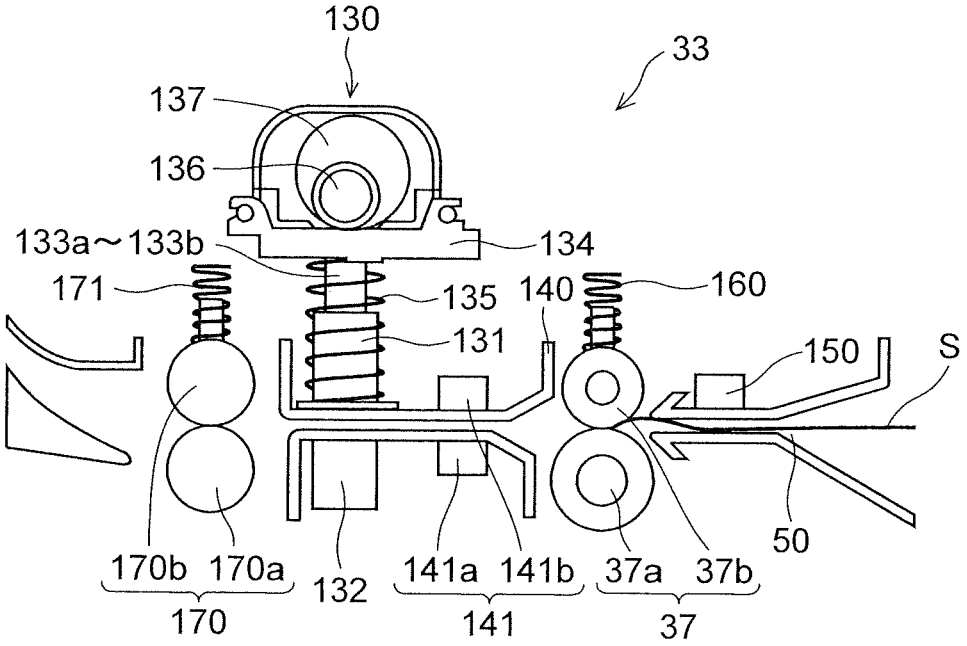
FIG. 12 is a view showing a structure in the vicinity of the punching device in the paper sheet post-processor of the second embodiment of the present disclosure, which illustrates a state where a warp is being formed in a paper sheet by a registration roller.

When it is instructed to form punch holes along a rear end of the paper sheet S, while a rotation stopped state of the registration roller 37 is maintained, as shown in FIG. 12, the tip end of the paper sheet S is brought into contact with the registration roller 37 so that a warp is generated in the paper sheet S, and thus skewing of the paper sheet S is corrected.

Figure 13:
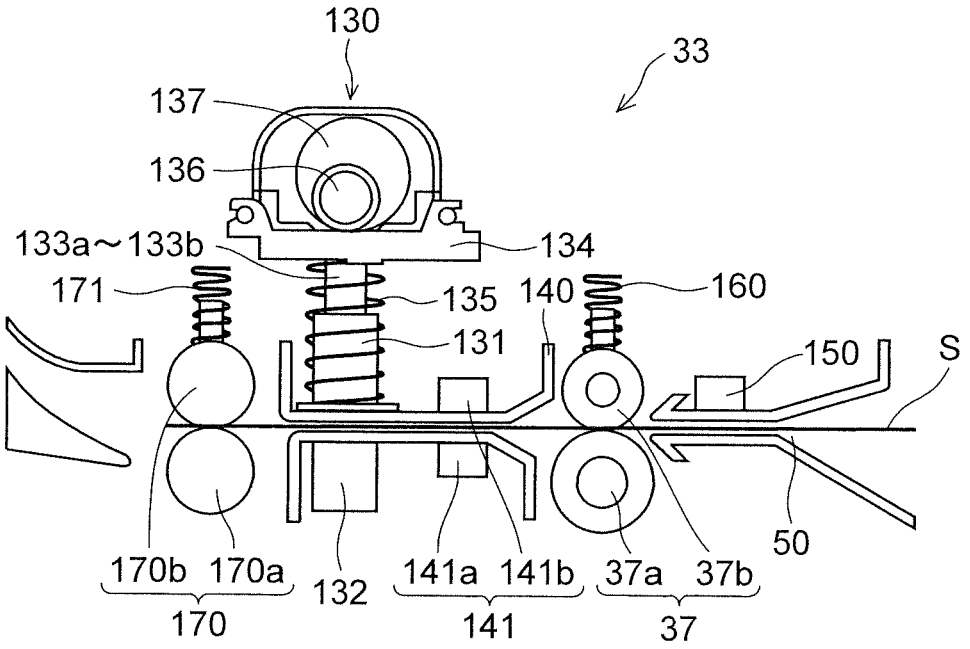
FIG. 13 is a view showing a structure in the vicinity of the punching device in the paper sheet post-processor of the second embodiment of the present disclosure, which illustrates a state where a paper sheet is being conveyed by a conveyance roller pair and the registration roller.

Subsequently, the registration roller 37 and the conveyance roller pair 170 are caused to rotate. Thus, the paper sheet S is conveyed in a state of being nipped by the registration roller 37, so that the warp is eliminated. After that, as shown in FIG. 13, the tip end of the paper sheet S is nipped by the conveyance roller pair 170, and the paper sheet S is conveyed by the registration roller 37 and the conveyance roller pair 170.

Then, a base portion 140 is caused to move in a paper sheet width direction, and thus an edge sensor 141 detects a second side end edge of the paper sheet S. Based on a result of this detection, the base portion 140 is disposed at a prescribed position in the paper sheet width direction. A configuration may also be adopted in which, before the tip end of the paper sheet S reaches the conveyance roller pair 170, the base portion 140 is caused to move in the paper sheet width direction, and the second side end edge of the paper sheet S is detected by the edge sensor 141.

After that, the rear end of the paper sheet S passes through the tip end detection sensor 150, and thus the tip end detection sensor 150 detects the rear end of the paper sheet S. Based on a result of this detection, the paper sheet S is conveyed further by a prescribed amount (until positions on the paper sheet S at which punch holes are to be formed are positioned immediately under punch members 133*b* and 133*c*).

Figure 14:
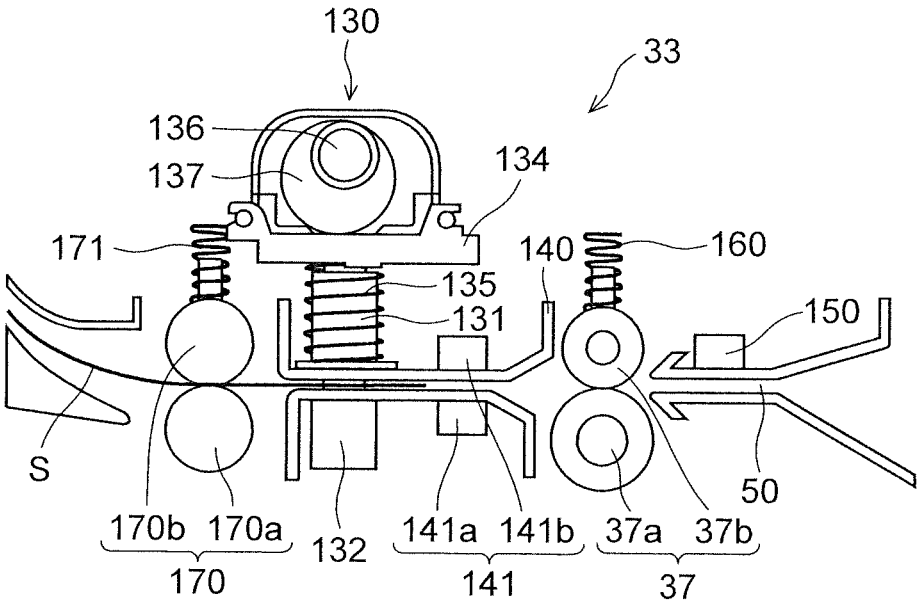
FIG. 14 is a view showing a structure in the vicinity of the punching device in the paper sheet post-processor of the second embodiment of the present disclosure, which illustrates a state where punch holes are being formed along a rear end of a paper sheet.

Then, as shown in FIG. 14, the punch members 133*b* and 133*c* are caused to descend and ascend to form punch holes along the rear end of the paper sheet S. At this time, the paper sheet S is temporarily stopped from being conveyed. After that, the conveyance roller pair 170 conveys the paper sheet S toward paper sheet conveyance paths 51 to 53, and thus the punch hole formation process by the paper sheet post-processor 30 is completed.

On the other hand, when it is instructed to form one or more (herein, four) punch holes along the second side end edge of the paper sheet S, while a rotation stopped state of the registration roller 37 is maintained, as shown in FIG. 12, a tip end of the paper sheet S is brought into contact with the registration roller 37 so that a warp is generated in the paper sheet S, and thus skewing of the paper sheet S is corrected.

Then, the registration roller 37 and the conveyance roller pair 170 are caused to rotate. Thus, the paper sheet S is conveyed in a state of being nipped by the registration roller 37.

After that, at timing when the tip end of the paper sheet S (or a position thereon at which a first punch hole is to be formed) reaches the edge sensor 141, the base portion 140 is caused to move in the paper sheet width direction, and thus the edge sensor 141 detects the second side end edge of the paper sheet S. Based on a result of this detection, the base portion 140 is positioned at a prescribed position in the paper sheet width direction. When it is instructed to form two or less punch holes along the second side end edge of the paper sheet S, a configuration may be adopted in which, after a tip end of the paper sheet S has reached the conveyance roller pair 170, the base portion 140 is caused to move in the paper sheet width direction, and the second side end edge of the paper sheet S is detected by the edge sensor 141.

Then, as shown in FIG. 13, the tip end of the paper sheet S is nipped by the conveyance roller pair 170, and the paper sheet S is conveyed by the registration roller 37 and the conveyance roller pair 170.

Figure 15:
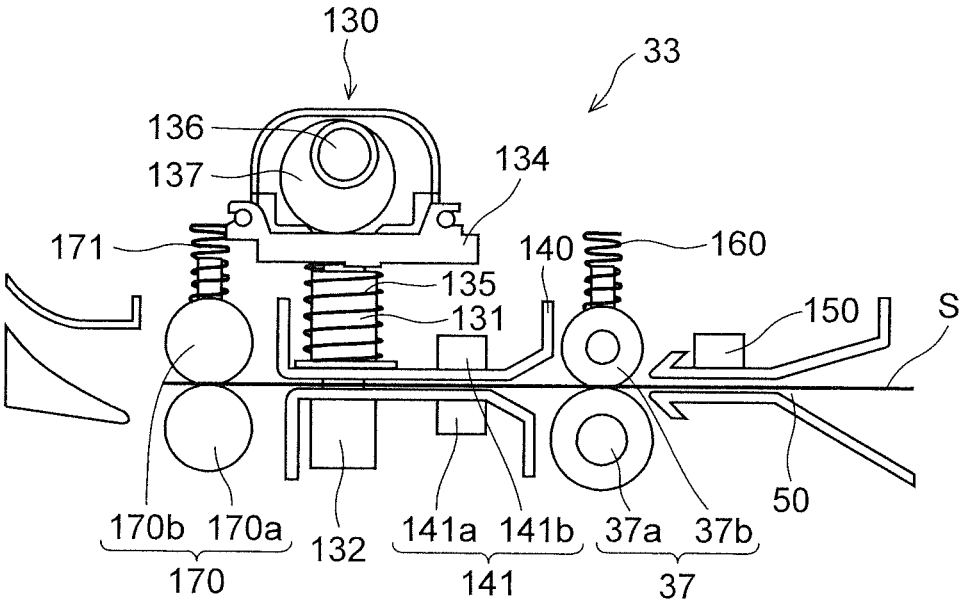
FIG. 15 is a view showing a structure in the vicinity of the punching device in the paper sheet post-processor of the second embodiment of the present disclosure, which illustrates a state where punch holes are being formed along a second side end edge of a paper sheet.

After that, as shown in FIG. 15, when a position on the paper sheet S at which a first punch hole is to be formed reaches the punch member 133*a*, the paper sheet S is temporarily stopped from being conveyed, and the punch member 133*a* is caused to descend and ascend to form the first punch hole through the paper sheet S.

Then, the paper sheet S is conveyed further by the registration roller 37 and the conveyance roller pair 170, and every time a position on the paper sheet S at which each of second, third, and fourth punch holes is to be formed reaches the punch member 133*a*, the paper sheet S is temporarily stopped from being conveyed, and the punch member 133*a* is caused to descend and ascend to form the second, third, and fourth punch holes through the paper sheet S.

After that, the conveyance roller pair 170 conveys the paper sheet S toward the paper sheet conveyance paths 51 to 53, and thus the punch hole formation process by the paper sheet post-processor 30 is completed.

Other operations in the second embodiment are performed similarly to those in the foregoing first embodiment.

In this embodiment, as described above, in a case where the registration roller 37 is disposed upstream of the punch unit 130 in the paper sheet conveyance direction and punch holes are formed along the second side end edge of the paper sheet S, after skewing of the paper sheet S has been corrected by the registration roller 37, the punch unit 130 and the edge sensor 141 move in the paper sheet width direction, and the edge sensor 141 detects the second side end edge of the paper sheet S, while the punch unit 130 forms punch holes through the paper sheet S. Thus, unlike the conventional type of paper sheet post-processor, in a case of forming punch holes along the second side end edge of a paper sheet, after the edge sensor has detected the second side end edge of the paper sheet, correction of skewing of the paper sheet is not performed by the registration roller. This can suppress a phenomenon in which a position of the second side end edge of a paper sheet in the paper sheet width direction varies under an influence of registration correction. Thus, punch holes can be formed with accuracy at desired positions along the second side end edge of the paper sheet S.

Furthermore, as described above, even in a case of forming two or more punch holes along the second side end edge of the paper sheet S, it is only once that the edge sensor 141 performs detection of the second side end edge of the paper sheet S. In this embodiment, skewing of the paper sheet S is corrected by the registration roller 37, and thus the second side end edge of the paper sheet S is made parallel to the paper sheet conveyance direction. Thus, it is sufficient that detection of the second side end edge of the paper sheet S by the edge sensor 141 is performed only once.

Other effects of the second embodiment are similar to those of the foregoing first embodiment.

The embodiments disclosed herein are to be construed in all respects as illustrative and not limiting. The scope of the present disclosure is indicated by the appended claims rather than by the foregoing descriptions of the embodiments, and all changes that come within the meaning and range of equivalency of the claims are intended to be embraced therein.

For example, the foregoing embodiments have described, as an example, a configuration in which the image forming apparatus 10 and the paper sheet post-processor 30 are directly connected to each other. The present disclosure, however, is applicable also to a configuration in which an inserter that inserts interleaving paper is incorporated between the image forming apparatus 10 and the paper sheet post-processor 30.

Furthermore, the foregoing first embodiment has described an example in which, in a case of forming two or less punch holes along the second side end edge of the paper sheet S, skewing of the paper sheet S is corrected by using the registration roller 37. The present disclosure, however, is not limited thereto, and similarly to a case of forming three or more punch holes along the second side end edge of the paper sheet S, skew correction of the paper sheet S does not have to be performed.

Furthermore, the foregoing embodiments have described an example in which, in a case of forming a plurality of punch holes along the second side end edge of the paper sheet S after skewing of the paper sheet S has been corrected by using the registration roller 37, detection of the second side end edge of the paper sheet S by the edge sensor 141 is performed only once. The present disclosure, however, is not limited thereto. Even in a case of forming a plurality of punch holes along the second side end edge of the paper sheet S after skewing of the paper sheet S has been corrected by using the registration roller 37, the following configuration may be adopted. That is, with respect to each of punch holes to be formed, detection of the second side edge of the paper sheet S by the edge sensor 141 is performed. By this configuration, punch holes can be formed with more accuracy at desired positions along the second side end edge of the paper sheet S.

Furthermore, the foregoing embodiments have described an example in which the edge sensor 141 is disposed upstream of the punch members 133*a* to 133*d* in the paper sheet conveyance direction. The present disclosure, however, is not limited thereto. For example, the edge sensor 141 may be disposed on a common straight line with the punch members 133*a* to 133*d*. By this configuration, the second side end edge of the paper sheet S immediately lateral (outward in the paper sheet width direction) to a position on the paper sheet S at which each of punch holes is to be formed can be detected, and thus a distance from the second side end edge of the paper sheet S to the each of punch holes can be set more precisely.

What is claimed is:

1. A sheet post-processor, comprising:

a punching device that is capable of forming punch holes along a first side end edge of a sheet parallel to a sheet width direction orthogonal to a sheet conveyance direction and a second side end edge of the sheet parallel to the sheet conveyance direction and moves in the sheet width direction; and a registration roller that is disposed downstream of the punching device in the sheet conveyance direction, which corrects skewing of the sheet by warping the sheet with a tip end of the sheet in contact with the registration roller in a rotation stopped state before formation of punch holes, and then conveys the sheet, wherein the punching device includes:

a punch unit that forms punch holes through the sheet;

an edge sensor that detects the second side end edge of the sheet; and a base portion that mounts the punch unit and the edge sensor and moves in the sheet width direction, and in a case of forming punch holes along the second side end edge of the sheet, the registration roller is rotated before the tip end of the sheet comes into contact with the registration roller so as not to warp the sheet, without skewing of the sheet being corrected by the registration roller, the base portion moves together with the punch unit and the edge sensor in the sheet width direction, and the edge sensor detects the second side end edge, while the punch unit as positioned based on a result of detection by the edge sensor forms punch holes through the sheet in a state where the sheet is stopped from being conveyed at a prescribed position and is nipped by the registration roller.

2. The sheet post-processor according to claim 1, wherein in a case of forming punch holes along the second side end edge of the sheet, with respect to each of the punch holes to be formed, the base portion moves in the sheet width direction, and the edge sensor detects the second side end edge.

3. A sheet post-processor according to claim 1, comprising:

a punching device that is capable of forming punch holes along a first side end edge of a sheet parallel to a sheet width direction orthogonal to a sheet conveyance direction and a second side end edge of the sheet parallel to the sheet conveyance direction and moves in the sheet width direction; and a registration roller that is disposed downstream of the punching device in the sheet conveyance direction, which corrects skewing of the sheet before formation of punch holes, and then conveys the sheet, wherein the punching device includes:

a punch unit that forms punch holes through the sheet:

an edge sensor that detects the second side end edge of the sheet; an a base portion that mounts the punch unit and the edge sensor and moves in the sheet width direction, and in a case of forming punch holes along the second side end edge of the sheet, when a distance in the sheet conveyance direction from a tip end of the sheet to a position on the sheet at which a first punch hole is to be formed is less than a prescribed value, without skewing of the sheet being corrected by the registration roller, the base portion moves together with the punch unit and the edge sensor in the sheet width direction, and the edge sensor detects the second side end edge, while the punch unit as positioned based on a result of detection by the edge sensor forms punch holes through the sheet, and when the distance is not less than the prescribed value, after skewing of the sheet has been corrected by the registration roller, while the base portion moves in the sheet width direction, the edge sensor detects the second side end edge and the punch unit forms punch holes through the sheet.

4. An image forming system, comprising:

the sheet post-processor according to claim 1; and an image forming apparatus to which the sheet post-processor is coupled and that forms an image on a sheet.

* * * * *